US006390493B1

(12) United States Patent
Hauglin

(10) Patent No.: US 6,390,493 B1
(45) **Date of Patent: *May 21, 2002**

(54) COMBINATION OF A SKI BINDING AND OF A BOOT ADAPTED THERETO

(75) Inventor: Bernt-Otto Hauglin, Royken (NO)

(73) Assignee: Rottefella A/S, Klokkarstua (NO)

( * ) Notice: Subject to any disclaimer, the term of this patent is extended or adjusted under 35 U.S.C. 154(b) by 0 days.

This patent is subject to a terminal disclaimer.

(21) Appl. No.: 09/299,337

(22) Filed: Apr. 26, 1999

Related U.S. Application Data

(62) Division of application No. 08/875,539, filed on Oct. 28, 1997, now Pat. No. 5,897,127.

(30) Foreign Application Priority Data

Feb. 2, 1995 (DE) ..... 195 03 397
May 15, 1995 (DE) ..... 196 17 791

(51) Int. Cl.[7] ..... A63C 9/00
(52) U.S. Cl. ..... 280/615; 280/613; 280/623
(58) Field of Search ..... 280/613, 614, 280/615, 623, 626, 631, 619, 620

(56) References Cited

U.S. PATENT DOCUMENTS 2,208,829 A * 7/1940 Barieu ..... 280/619
2,246,152 A * 6/1941 Wallace ..... 280/614
2,246,153 A * 6/1941 Wallace ..... 280/614
2,554,706 A * 5/1951 Johansen ..... 280/615
2,586,339 A * 2/1952 Hvam ..... 280/615
2,610,068 A * 9/1952 Majneri ..... 280/615
2,655,386 A * 10/1953 Kutschera ..... 280/614
2,685,448 A * 8/1954 Walker ..... 280/615
2,686,059 A * 8/1954 Whitaker ..... 280/515
2,758,846 A * 8/1956 Swensen ..... 280/615
2,764,418 A * 9/1956 Shimizu ..... 280/615
5,052,710 A * 10/1991 Provence et al. ..... 280/615
5,282,642 A * 2/1994 Provence ..... 280/615
5,499,838 A * 3/1996 Hauglin et al. ..... 280/615
5,518,264 A * 5/1996 Broughton ..... 280/615
5,595,396 A * 1/1997 Bourdeau ..... 280/607
5,664,797 A * 9/1997 Haughlin ..... 280/615
5,669,622 A * 9/1997 Miller ..... 280/615
5,897,127 A * 4/1999 Hauglin ..... 280/615

FOREIGN PATENT DOCUMENTS

CH 172405 * 10/1934
WO WO 84/03225 * 8/1984

* cited by examiner

*Primary Examiner*—Kevin Hurley
*Assistant Examiner*—Andrew J. Fischer
(74) *Attorney, Agent, or Firm*—Andrus, Sceales, Starke & Sawall

(57) ABSTRACT

A combination of a ski binding (10), particularly cross-country, touring or telemark binding, and of a boot (11) adapted thereto are shown, the front end of which is held by a resiliently biased clamp member (12; 48) in the binding (10) in such a way that the heel (13) of the boot (11) can be freely raised during ski touring or cross-country skiing. The clamp member (12; 48) engages on the forward sole (15) of the boot (11) particularly between the ball area and the rear end of the same, and preferably on the underside of the boot forward sole (15).

17 Claims, 12 Drawing Sheets

Figure 1:
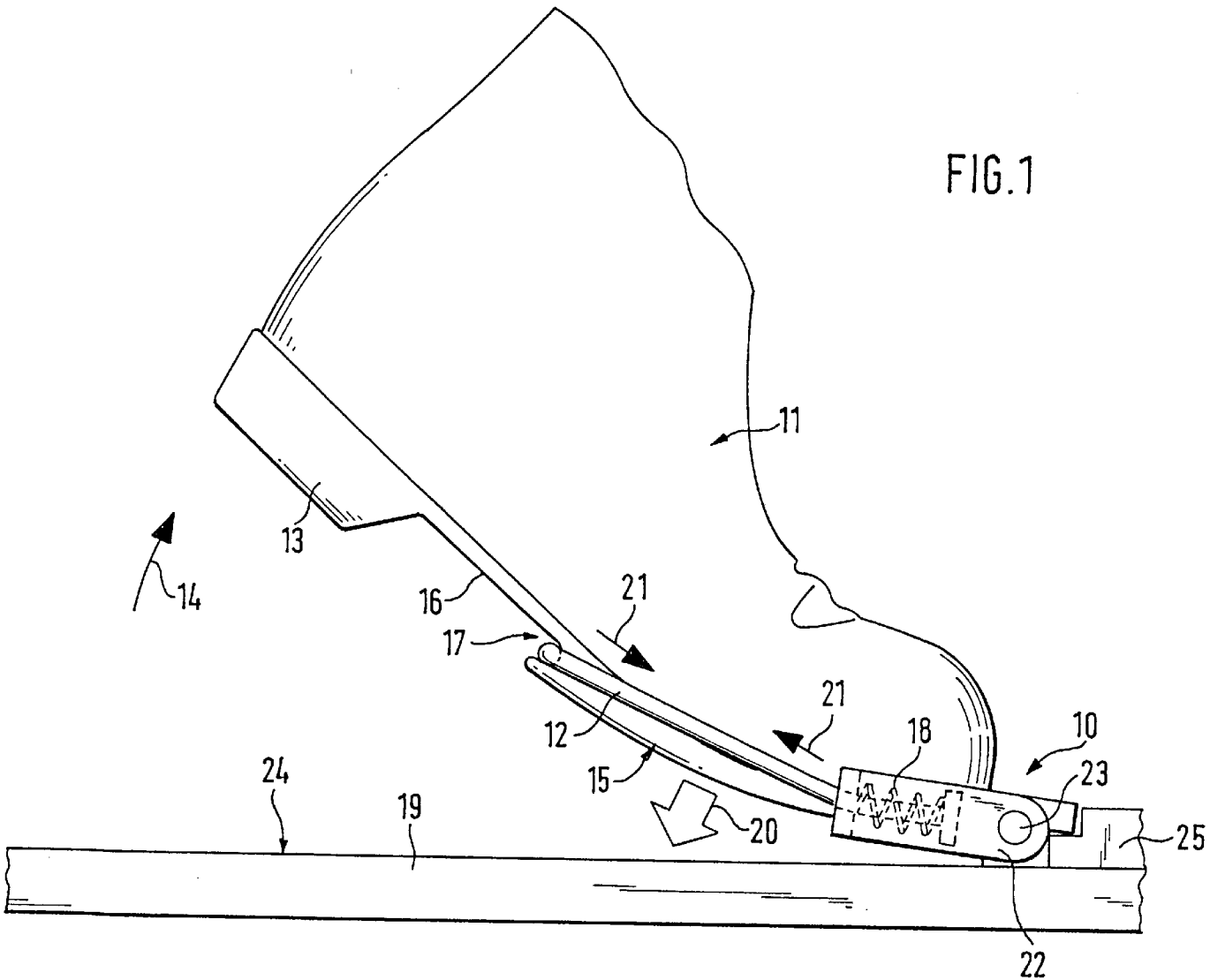

FIG. 8
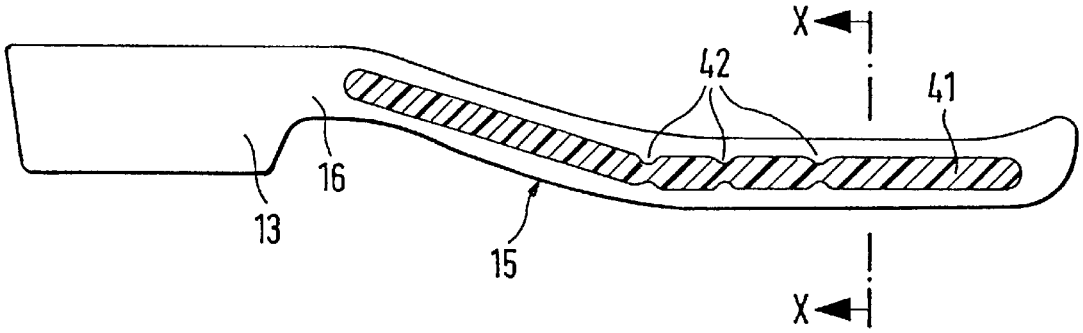
FIG. 9
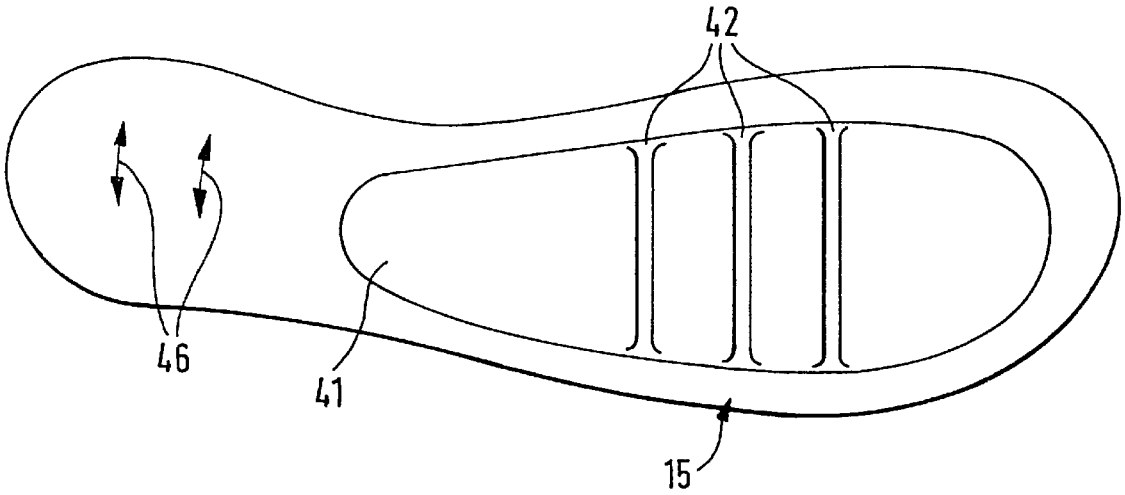
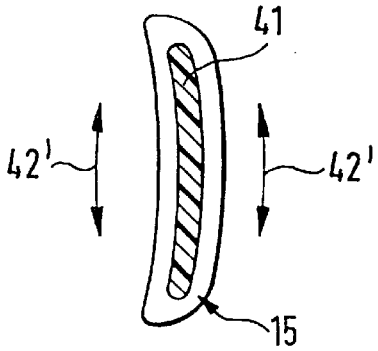
FIG. 10

COMBINATION OF A SKI BINDING AND OF A BOOT ADAPTED THERETO

This is a division of application Ser. No. 08/875,539, now U.S. Pat. 5,897,127 filed Oct. 28, 1997.

DESCRIPTION

The invention relates to a combination of a ski binding, particularly a cross-country, touring or telemark binding and of a boot adapted thereto, the forward end of which is held in the binding by a resiliently biased clamping element in such a way that the heel of the shoe can be freely raised when used in touring, cross-country skiing or the like use.

Such combinations of a ski binding and of a boot adapted thereto are generally known; in the known solutions a clamp cable is passed around the boot heel as a retaining member. Such a construction is for example described in FR-A 756 374 or CH-A-194 783. For a corresponding construction of a touring ski binding, reference is made to DE-C 35 39 315. All these known combinations are relatively bulky in construction. A disadvantage is also that lifting of the boot heel during touring, cross-country skiing or downhill skiing in the telemark style is in fact prevented by the clamp cable passed around the boot heel. In addition, when the clamp cable is arranged around the boot heel the said heel can be moved laterally, so that exact lateral guidance of the ski is not possible. The transfer of power to the ski is likewise impaired. Finally, a considerable disadvantage is that the position of the bending line of the sole extending transversely to the longitudinal direction of the boot or sole is not defined. It migrates within a relatively large area, i.e. is displaced upon each lift of the boot heel. Consequently, the sole and boot deformation forces alter in a corresponding way. The cross-country skier is subjected to varying degrees of stress upon each lift of the boot heel.

There is known from DE-OS 41 03 068 a ski cross-country binding in which a clamp cable which can be passed around the boot heel fixes the ski boot to the cover surface of a ski-mounted toe iron by means of a clamp cable coupled to a tightening mechanism. In this case the clamp cable has a device for altering its effective length, and a part of the clamp cable is replaced by a traction spring. At the portion of the clamp cable which can be passed around the boot heel, a clamp lever which can be supported on the boot sole is mounted to pivot about a pivotal axis located parallel to the clamp cable. In this binding also, the above mentioned problems arise, due to the varying sole and boot deformation forces.

There is known from DE-GM 16 96 548 a ski binding with a tightening strap engaging on the forward end of a ski boot, the tightener mounted in front of the ski boot on the ski cover surface being engaged in a metal tab secured to the forward sole of the ski boot and drawing it between retaining jaws. This engagement binding is intended to ensure that it releases automatically during disconnections, as soon as the rear portion of the ski boot is raised to an unusual height from the ski cover surface. Such a ski binding enables only imprecise guidance of the ski and power transmission to the ski and is unsuitable both for cross-country skiing or for downhill skiing in the telemark style.

The object underlying the present invention is to improve the already mentioned combination of a ski binding and of a boot adapted thereto in that the boot heel can be raised substantially unhindered and to a great extent, and that a defined deformation of the boot or of the sole of the same is ensured, so that the ski guidance and power transmission to the ski are not impaired thereby and the maximum proportion of the energy applied by the skier can be converted into speed and ski guidance. In addition, the construction according to the invention is to be characterised by a compact structure.

This object is achieved in that the clamp member engages on the forward sole of the shoe, particularly between the area of the ball of the foot and the rear end.

According to a basic idea of the invention the clamp member is formed on a clamp cable which is passed around at least a portion of the forward sole. The clamp cable construction is reduced to a minimum without impairing the power transmission to the ski or the ski guidance. On the contrary, the binding of the boot both at the front end of the same and also at the forward sole between the ball area and the rear end of the same affords the skier a reliably functioning connection with the ski with, in comparison to prior art, considerably increased mobility of the boot heel. The double binding of the boot according to the invention leads to a greater degree of efficiency as regards power transmission. The ski guidance is also ensured by the coupling both at the forward end of the boot and also between the ball and the instep area of the forward sole. Accordingly the combination according to the invention is also quite specially suitable for the telemark style. According to another basic idea of the invention the clamp member is designed as a resilient elastic part in the plane defined by the raising of the boot heel, which is attached at the forward end of the ski to the ski itself or at the binding, while the rear-of-ski end may be coupled to the boot, particularly to its sole.

This construction with a resilient elastic portion or flexible retaining member permits a defined and substantially unhindered raising of the boot heel, precise ski guidance being ensured at any elevated position of the boot heel, in that the retaining member is resiliently elastic only in a longitudinal plane vertical to the ski cover surface. This also ensures that no force is lost through return of the rear end of the boot, moved towards the side, into a position parallel to the longitudinal direction of the ski, as is the case in previous cable bindings. The degree of efficiency with respect to power transmission is in this construction of the retaining member accordingly higher than in prior art. The combination according to the invention is thus suitable not only for cross-country skiing, but due to its good lateral guidance and improved power transmission, is particularly suitable for ski touring and downhill skiing, particularly in the telemark style.

The results of the flexible retaining member is that no large-dimension retaining jaws are required for the forward end of the boot for lateral stability. Thus the forward sole area can be just as soft as in a previous walking boot, as the boot is held both at its forward end by a retaining part on the binding, and also in the centre of the boot or in the ball area on the retaining member.

Finally, in the construction according to the invention the bending line of the sole is substantially defined, as it is determined by the bending line of the resilient elastic retaining member.

In all, by means of the invention a maximum proportion of the energy applied by the skier can be converted into ski guidance and/or speed.

Preferred constructive details and embodiments of the binding-boot combination according to the invention are described in the secondary claims, in which respect the sole measures according to claims 9 to 12 should be emphasised, by means of which a particularly resilient elastic rubber sole can be stabilised. Above all, the measures named there give rise to lateral stability and distortion resistance of the sole, so that the flexibility in the longitudinal direction of the boot is not impaired. Particular reference is also made to the measures according to claims 15 to 18, which permit a simple alteration in the bending line of the boot sole as required, particularly of the boot forward sole.

Figure 2:
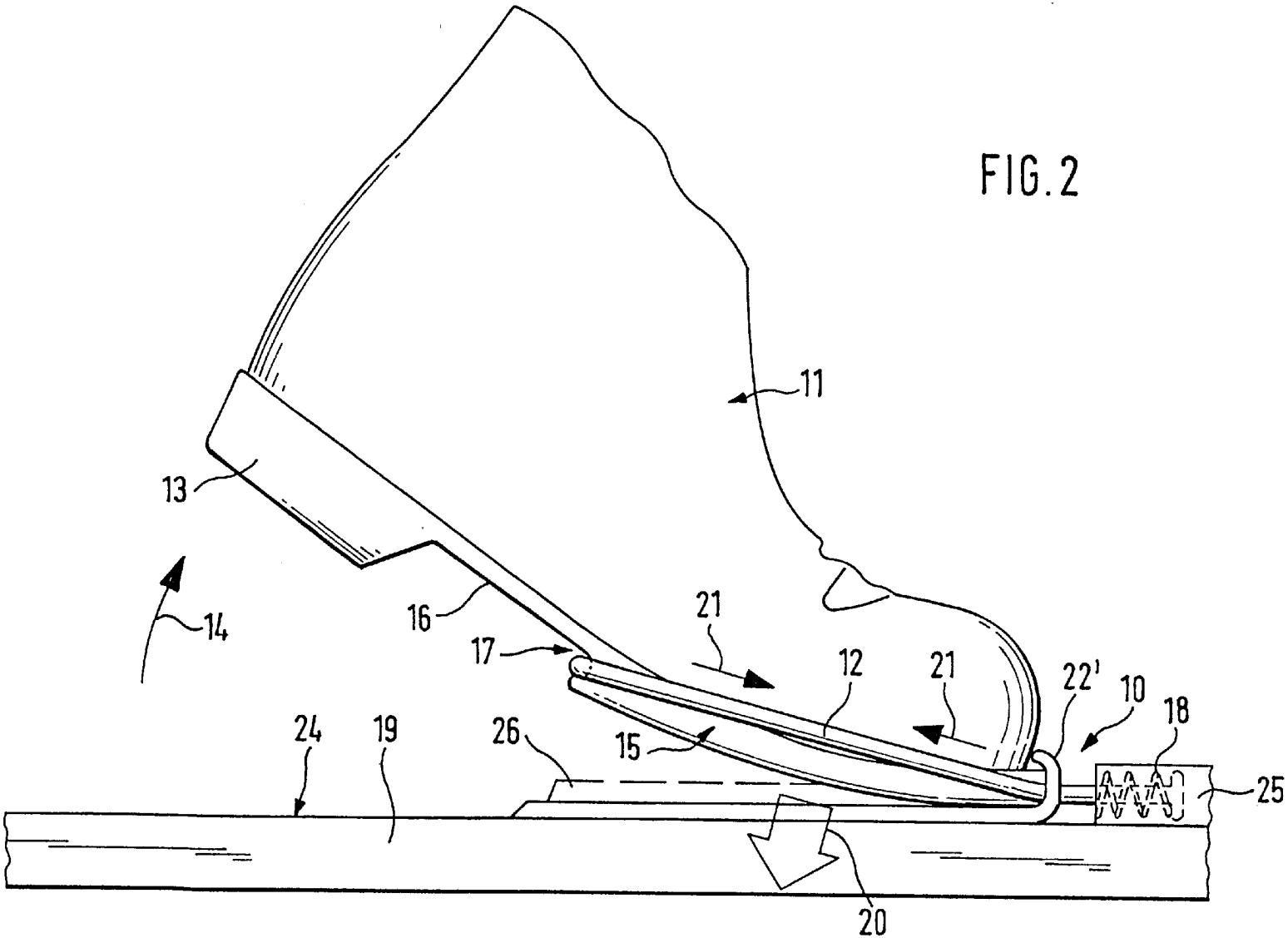
Figure 3:
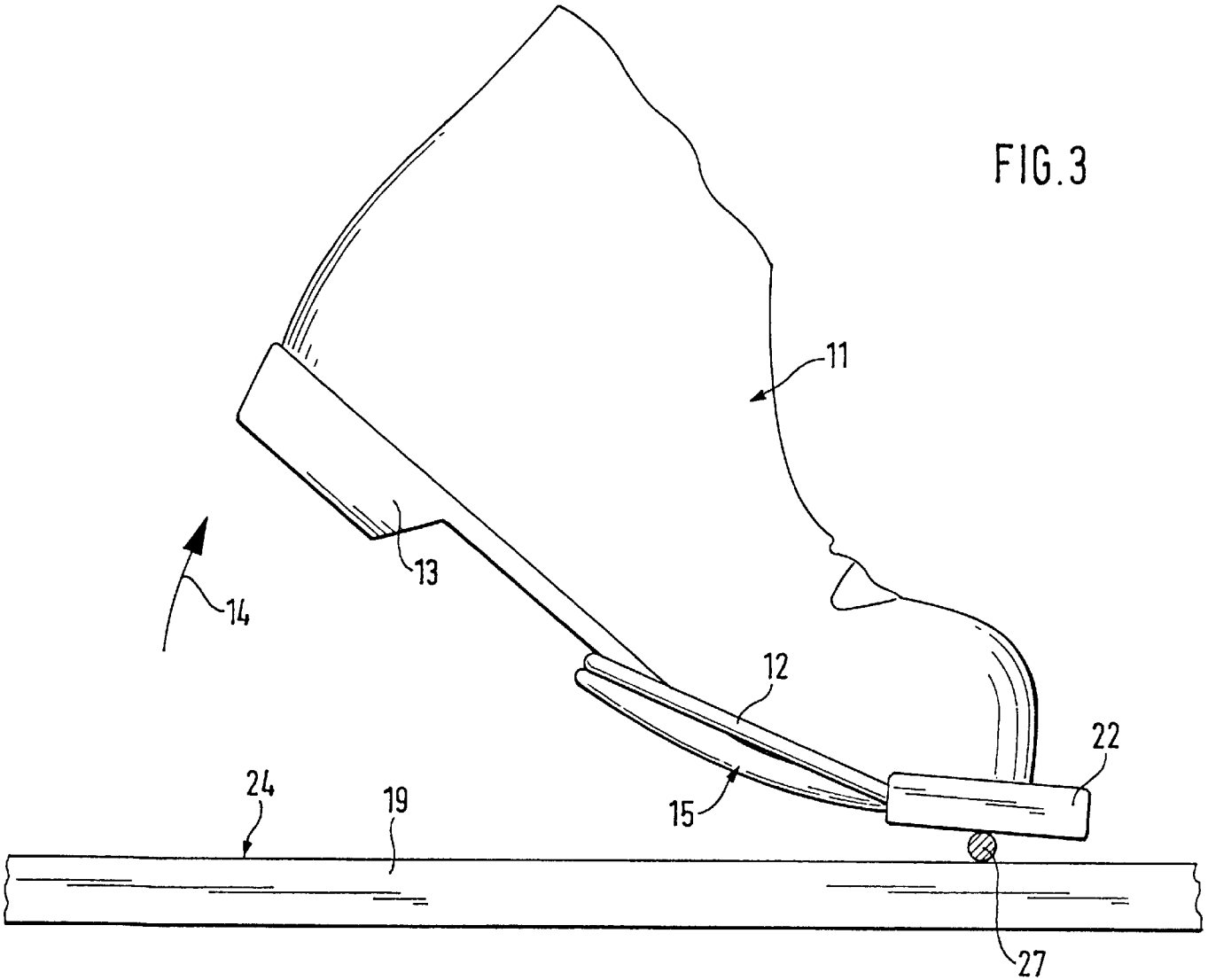
Figure 4:
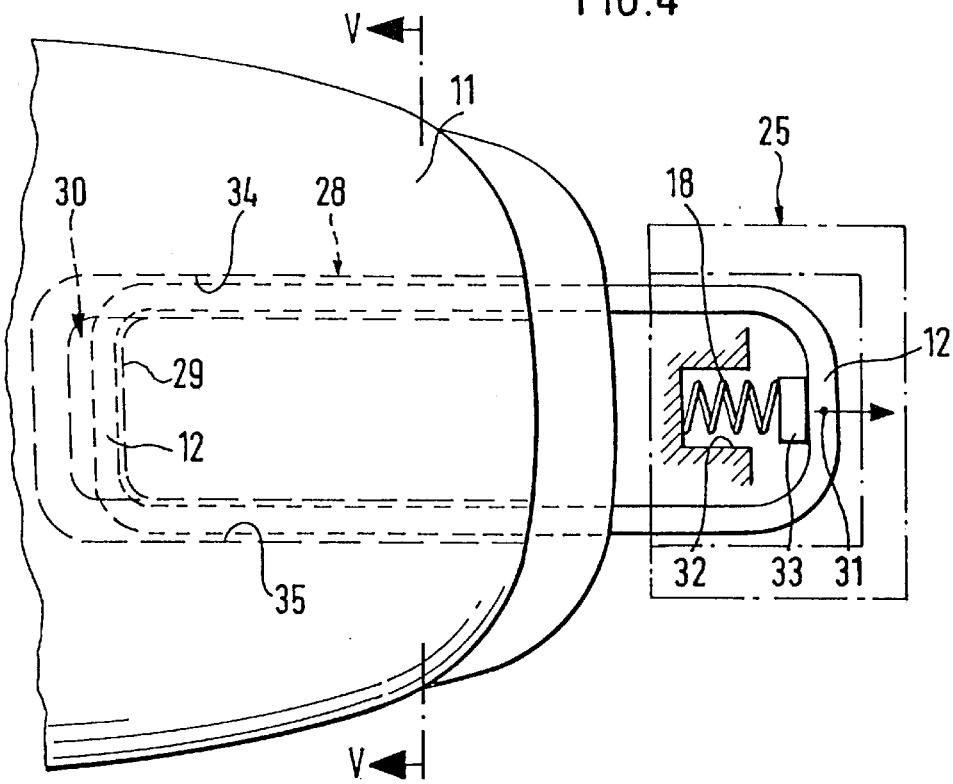
Figure 5:
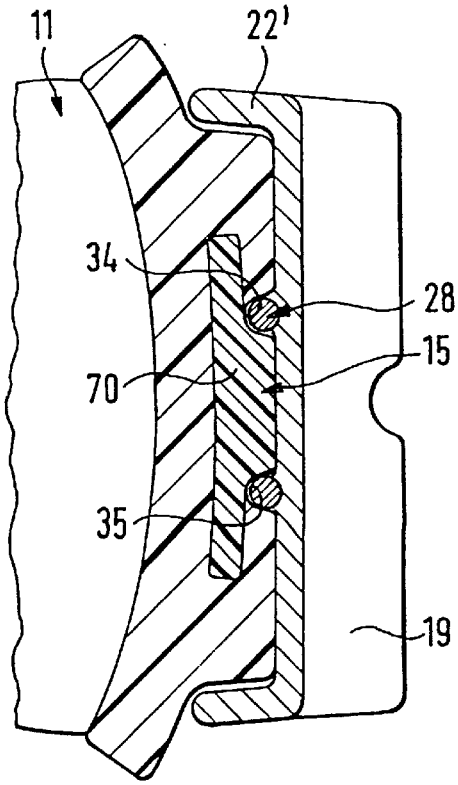
Figure 6:
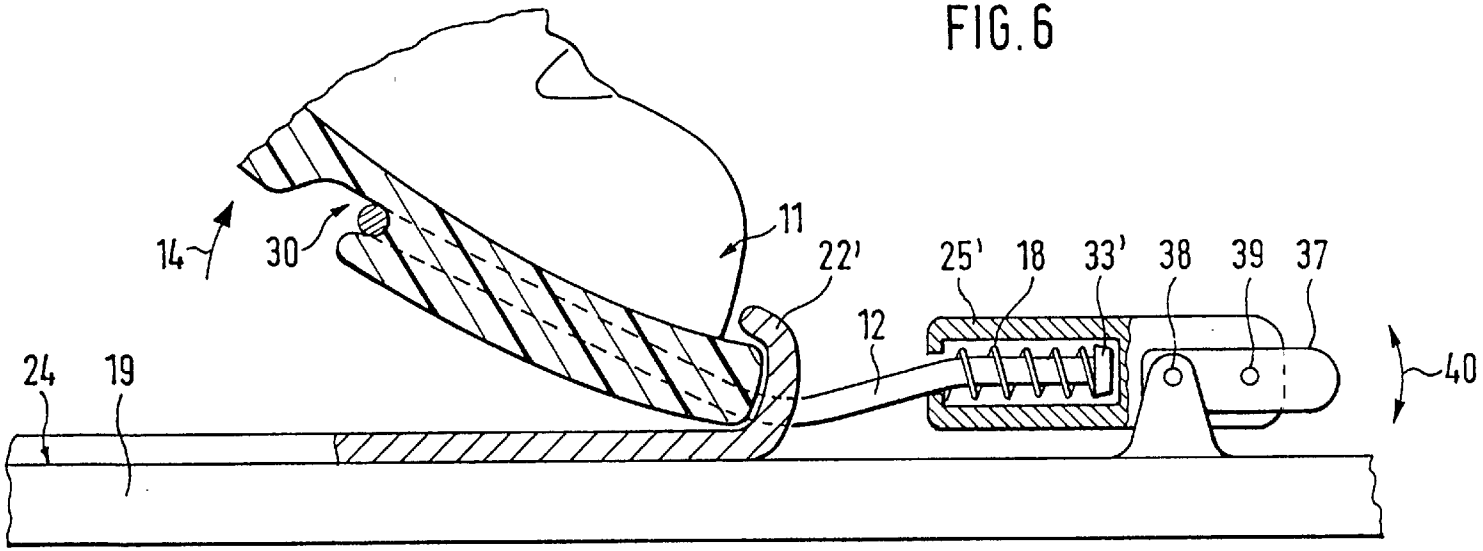
Figure 7:
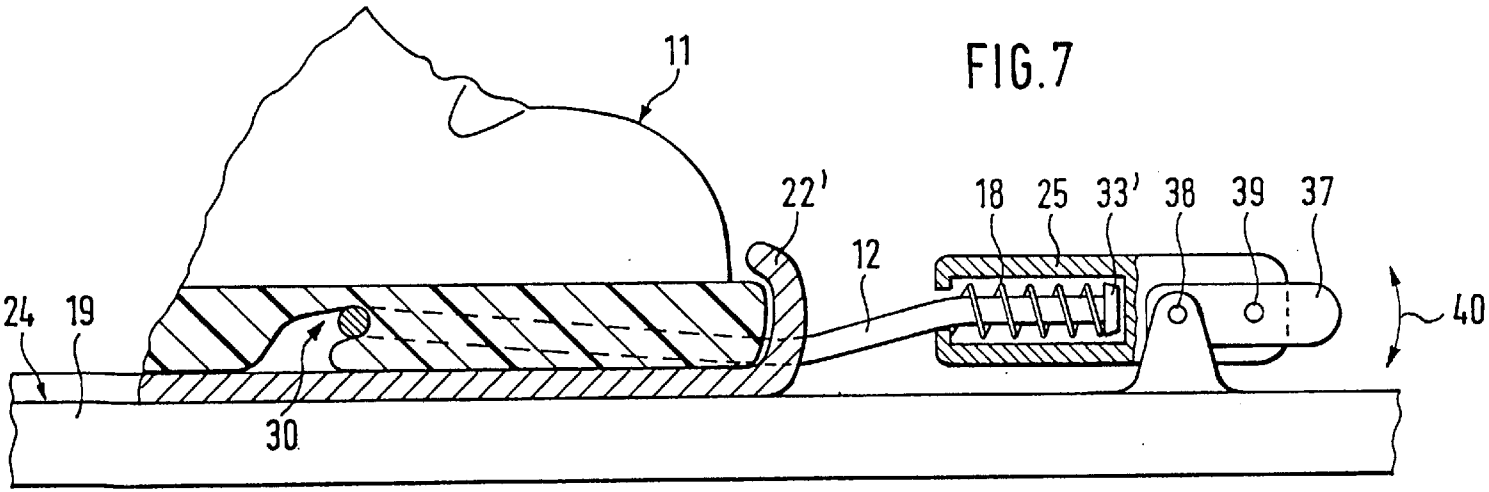
Figure 11:
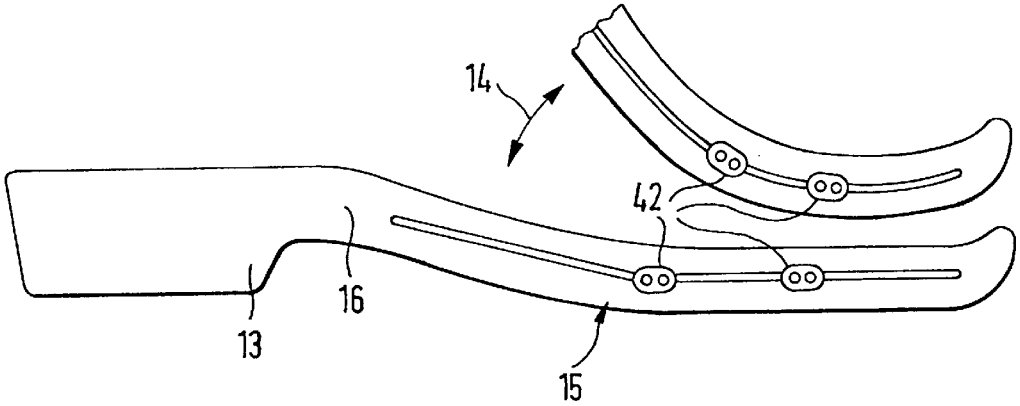
Figure 12:
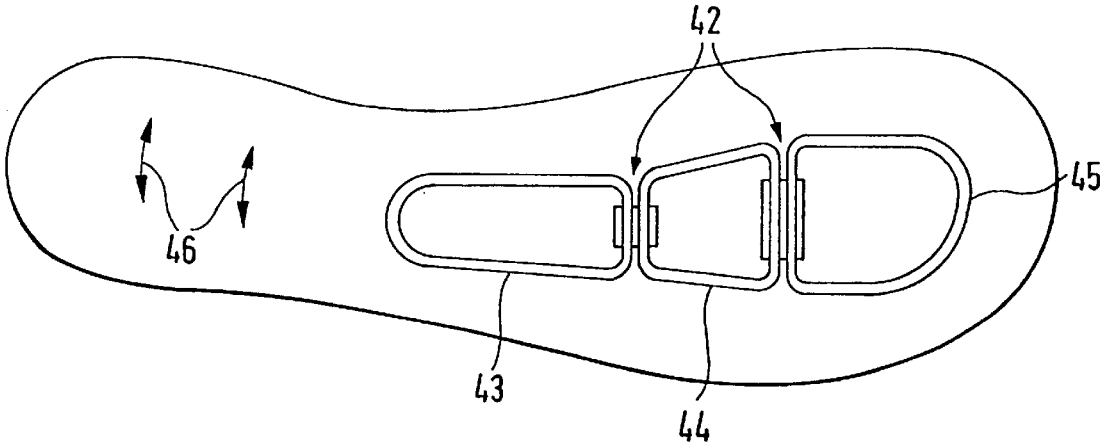
Figure 13:
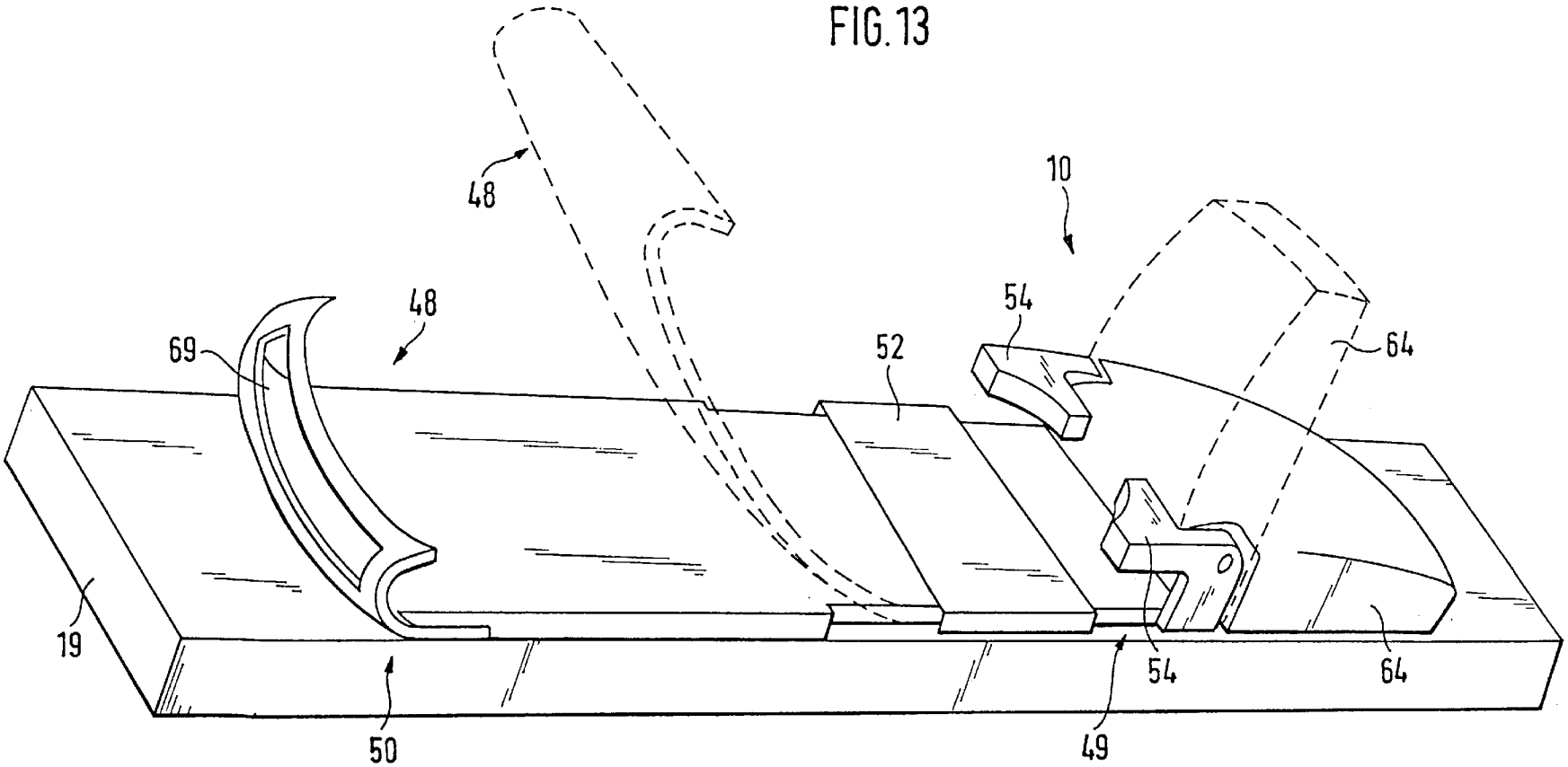
Figure 14:
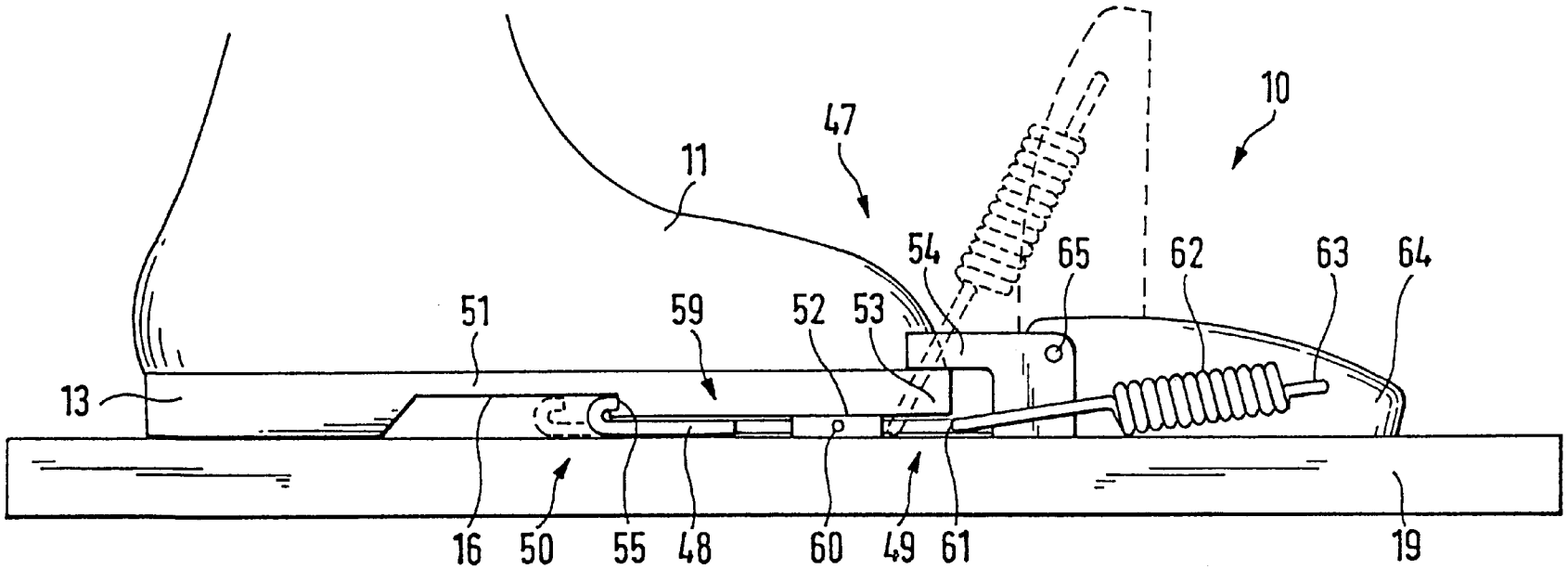
Figure 15:
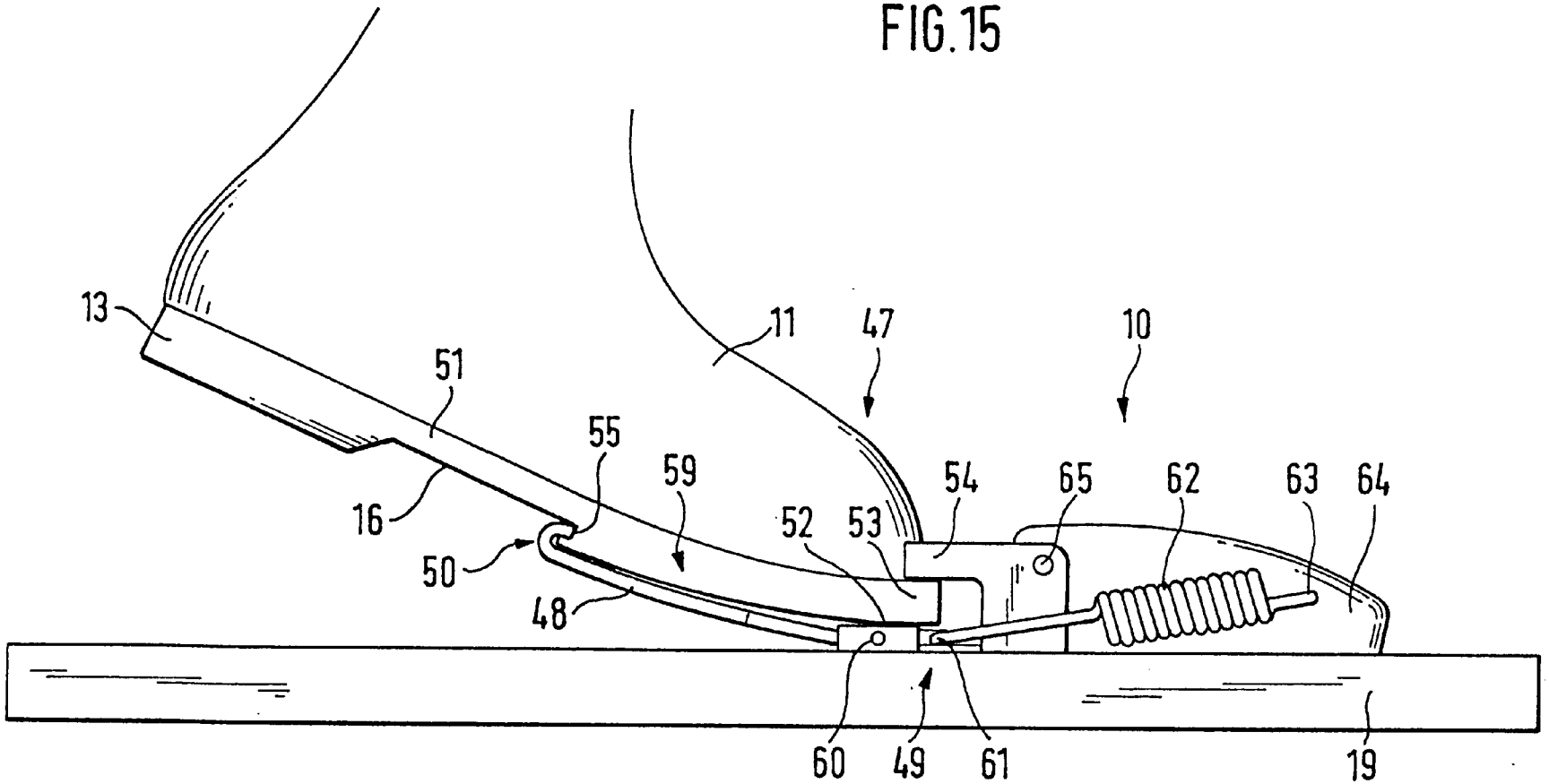
Figure 16:
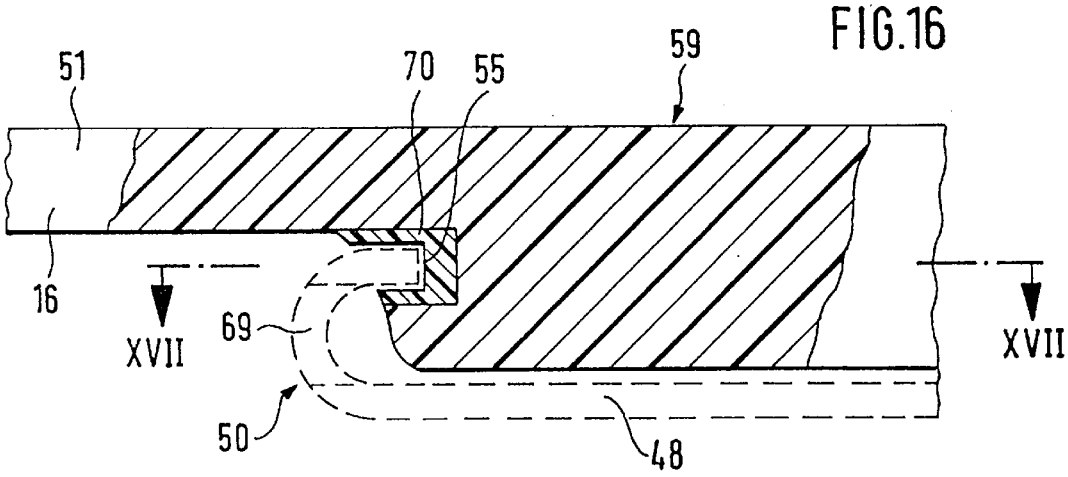
Figure 17:
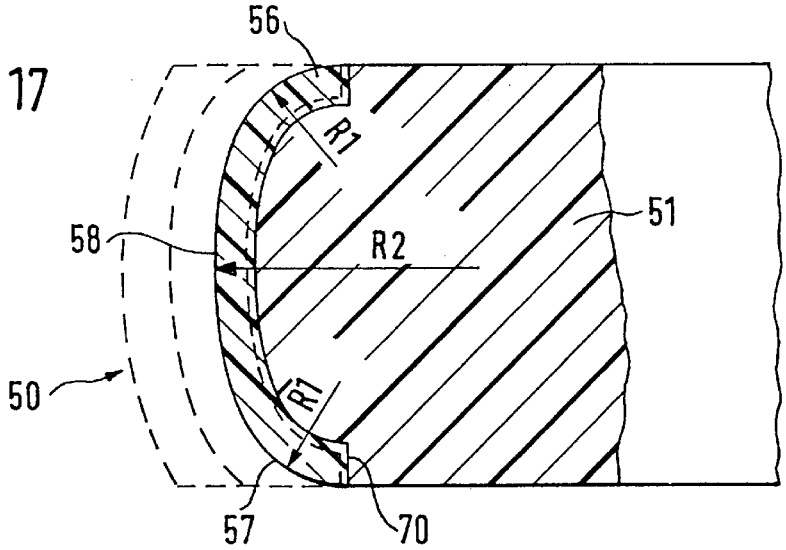
Figure 18:
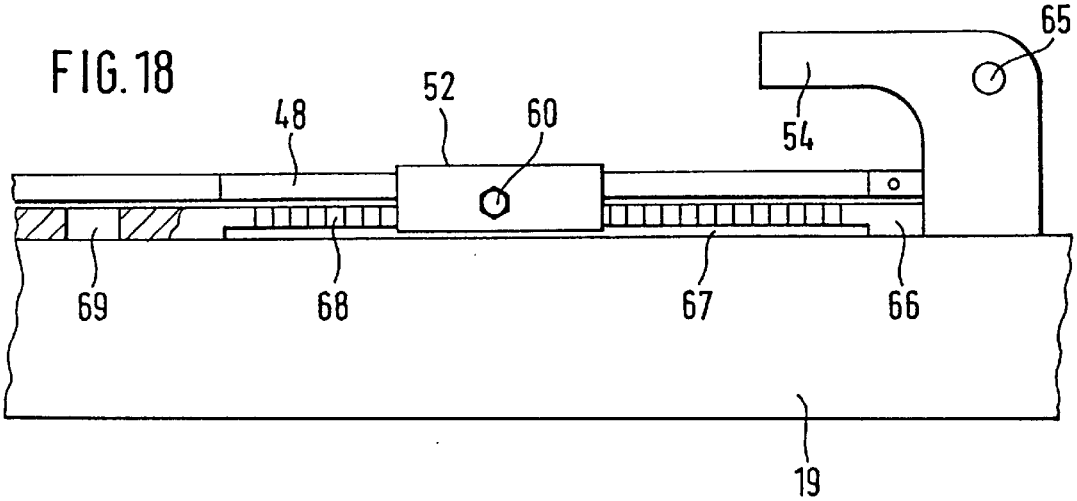
Figure 19:
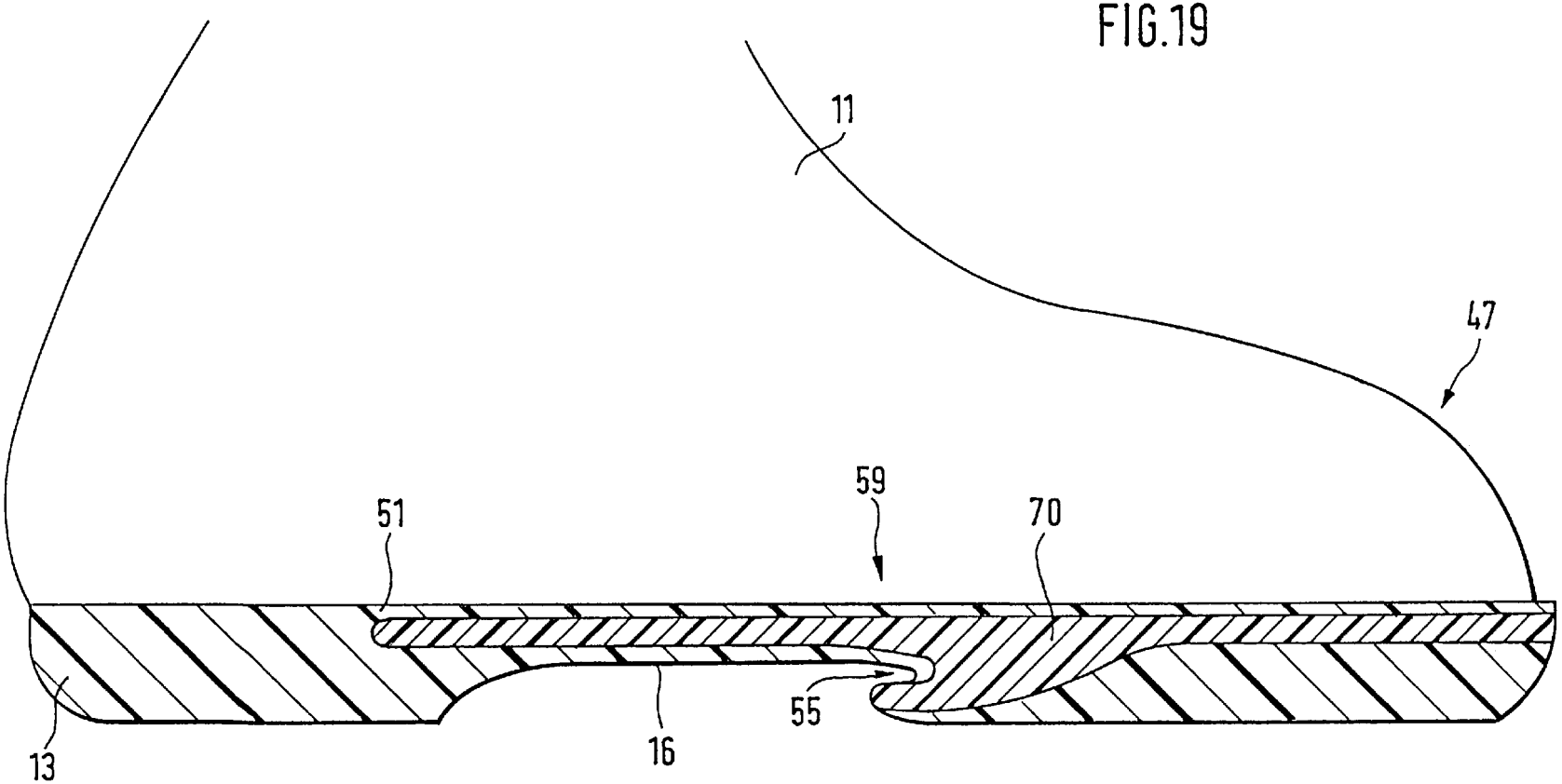

Embodiments of the combination of a ski binding and of a boot adapted thereto according to the invention and given by way of example will be explained in more detail with reference to the annexed drawings, which show:

FIG. 1: a first embodiment of a binding-boot combination according to the invention in schematic side elevation;

FIG. 2: a second embodiment of a combination according to FIG. 1 in schematic side view;

FIG. 3: a third embodiment of a combination according to the invention according to FIG. 1 in schematic side view;

FIG. 4: a portion of an inventive combination in schematic plan view;

FIG. 5: the embodiment according to FIG. 4 in cross-section along line V—V in FIG. 4;

FIGS. 6 & 7: the embodiment according to FIG. 2 in a schematic lateral sectional view with the boot (FIG. 6) raised and the heel (FIG. 7) lowered;

FIG. 8: a boot sole reinforced by an insert in schematic longitudinal section;

FIG. 9: the boot sole according to FIG. 8 in plan view, showing the reinforcing insert;

FIG. 10: the boot sole according to FIG. 8 in cross-section along line X—X in FIG. 8;

FIG. 11: an alternative embodiment for a boot sole with reinforcing insert in schematic longitudinal section;

FIG. 12: the boot sole according to FIG. 11 in plan view, showing the reinforcing insert;

FIG. 13: an embodiment of a ski binding designed according to the invention in a schematic-perspective view;

FIG. 14: a schematic side view of a further embodiment of the ski binding-shoe combination designed according to the invention, the boot heel not being raised;

FIG. 15: a schematic side view of the ski binding-boot combination designed according to the invention according to FIG. 14, the boot heel being raised;

FIG. 16: the connecting area of the boot sole for a corresponding retaining member of the binding in longitudinal section and on an enlarged scale;

FIG. 17: the connecting area of the boot sole according to FIG. 16 in cross-section along line XVII—XVII in FIG. 16;

FIG. 18: a displacement construction for a means of altering the effective length of the retaining member on an enlarged scale; and FIG. 19: the boot sole reinforced by an insert in schematic longitudinal section.

FIG. 1 shows in schematic side view a combination of a ski binding 10, i.e. a touring or telemark binding, and of a boot 11 adapted thereto, the forward end of which is held by a resilient elastic pre-biased clamp cable 12 in the binding 10 in such a way that the heel 13 of the boot 11 can be freely raised, i.e. in the direction of arrow 14. The clamp cable 12 is connected to the forward sole 15 of the boot 11, i.e. at the rear end of the forward sole. Alternatively, a connection can be provided in the ball area or between the ball area and the rear end of the forward sole. In concrete terms, in the transitional area between the forward sole 15 and the central area 16 of the same an undercutting 17 is provided which extends parallel to the sole and transversely to the longitudinal direction of the boot, and into which the clamp cable 12 may be engaged, correspondingly fixing the sole or the boot 11. The clamp cable 12 is resiliently biased by a helical spring 18 only indicated in FIG. 1. Against the action of this resilient bias, the heel 13 of the boot is raised in the direction of the arrow 14. The forward sole 15 thus curves according to FIG. 1 between its forward and rear end downwards in the direction of the arrow 20 towards the ski body 19. This curvature corresponds to the bending of the forward part of the foot when the boot heel 13 is raised. It is thus anatomically and in particular also ergonomically advantageous. This curvature is reinforced by the resilient elastic bias of the clamp cable 12 in the direction of the arrows 21.

The forward end of the boot 11, particularly the forward end of the forward sole 15, is held in a retaining jaw 22, and is supported both to the side and also forward and above. The retaining jaw 22 is articulated to the upper side of the ski body 19, the axis of articulation 23 extending parallel to the ski cover surface 24 and transversely to the longitudinal direction of the ski. The axis of articulation is mounted in a binding casing 25 not shown in further detail, which is securely connected to the ski body 19. Between the retaining jaw 22 and the binding casing 25 a flexor not shown in further detail may act, which supports the return movement of the boot from the raised position according to FIG. 1 on to the ski cover surface 24. This flexor construction is generally known, so that a more detailed illustration and description is unnecessary.

FIG. 2 shows an embodiment altered in contrast to FIG. 1 of a combination of ski binding and boot, parts already described with reference to FIG. 1 being provided in FIG. 2 with the same reference numbers. The difference between the embodiment according to FIG. 2 with that according to FIG. 1 resides in the fact that the tension spring 18 associated with the clamp cable 12 is located in the binding casing 25. Furthermore, the retaining jaw 22' supporting the forward end of the sole in all directions is not articulated on the upper side or on the ski cover surface 24 of the ski body 19, but is rigidly connected therewith. Accordingly the clamp cable is passed through the forward end of the retaining jaw 22' to the binding casing 25, or alternatively runs laterally past the retaining jaw 22'. Otherwise the function is the same as that of the arrangement according to FIG. 1.

On the upper side of the leg of the retaining jaw 22' connected to the ski cover surface 24 of the ski body 19 a guide rib 26 extending in the longitudinal direction of the ski can be located or formed, which interacts with a corresponding guidance groove on the underside of the boot sole, particularly the forward sole 15. The guide rib 26 is indicated by a dotted line in FIG. 2. In this constructive feature there is involved likewise a known embodiment, which need not be illustrated or described in more detail here.

The embodiment according to FIG. 3 is comparable with that in FIG. 1, with the only difference that the retaining jaw 22 is mounted to pivot or tilt in the fashion of a rocker on a round bolt 27 located on the ski cover surface 24 and extending transversely to the longitudinal direction of the ski. The bias spring 18 is located within the retaining jaw 22 and is not shown in further detail in FIG. 3. Nor is there in FIG. 3 any more detailed illustration of how the retaining jaw 22 is held on the round bolt 27. This is not the concern here; the decisive factor is the basic principle shown in FIG. 3 of the interaction between retaining jaw 22 and clamp cable 12 on the one hand and retaining jaw 22 and ski body 19 on the other hand.

In FIG. 4 there is shown the forward portion of a boot 11 in plan view, the construction of interest here, of the underside of the forward sole 15, being shown in dotted lines. Accordingly on the underside of the boot forward sole 15 there is located or inserted a groove 28 formed on said sole and U-shaped in plan view, for receiving the clamp cable 12, which is indicated in the right-hand half of FIG. 4, in such a way that the U-shaped groove 28 is open to the front. The transverse web 29 of the groove 28 formed at a spacing from the forward end of the sole is undercut in order positively to engage the clamp cable 12 in the forward direction. This undercutting is indicated in FIG. 4 by the reference number 30. Furthermore, in FIG. 4 the helical compression spring 18 is shown, biasing the clamp cable 12 in the direction of the arrow 31 (closing direction), said spring being supported at one end within a receiving means 32 in the binding casing 25 indicated in part in dotted lines, and at the other end via a pressure member 33 on the clamp cable 12, simultaneously serving for guiding the cable in the binding casing 25.

The transverse web 29 of the groove 28 is according to FIG. 4 formed more widely than the legs 34, 35 of the same extending roughly parallel to the longitudinal direction of the boot. In particular the transverse web 29 is roughly twice as wide as the longitudinal legs 34, 35. In this way insertion of the clamp cable 12 is considerably facilitated. The same applies to release of the clamp cable 12 from the groove 28 when stepping out of the binding.

According to FIG. 5, the portion of the lower half of the forward sole 15 defined by the clamp cable groove 28 is produced from a hard elastic plastic, while the rest of the sole consists of soft elastic plastic or rubber. In this way higher strength of the forward sole in the area of engagement of the clamp cable 12 is obtained without impairing the flexibility of the remaining sole. At the same time, due to the hard elastic insert, which is identified in FIG. 5 by the reference number 36, an increased distortion resistance of the sole is obtained.

In FIG. 5, the retaining jaw 22' can be recognised, supporting the forward end of the sole to the side, upwards and forwards and rigidly connected to the ski body 19.

In FIGS. 6 and 7 the function of an embodiment similar to that according to FIGS. 4 and 5 is shown schematically. FIG. 5 shows the forward end of the boot 11 with the boot heel raised, while in FIG. 7 the boot heel is lowered on to the ski cover surface 24 of the ski body 19. Accordingly, with the boot heel raised according to FIG. 6, the spring 18 biasing the clamp cable 12 is compressed, while with the boot heel lowered it is relatively relaxed, i.e. only exerts a slight traction on the clamp cable 12. In the embodiment according to FIGS. 6 and 7, the tension spring 18 associated with the clamp cable 12 is located in a movable casing 25' which is movable, by means of a band lever 37 not shown in further detail, out of the closed position shown in FIGS. 6 and 7 into a boot release position and vice versa. The closing lever 37 is pivotally connected via a pivotal axis 38 to the ski body 19 on the one hand and via an axis of articulation 39 with the casing 25' enclosing the bias spring 18 on the other hand, the pivoting axis 38 and axis of articulation extending parallel to one another and to the ski cover surface 24 and transversely to the longitudinal direction of the ski. In the closed position of the clamp lever 37 the axis of articulation 39 is located beneath the connecting line between pivotal axis 38 and the longitudinal axis of the bias spring 18 (past dead point position). The pivotal mobility of the clamp lever 37 is indicated in FIGS. 6 and 7 by the double arrow 40. In the embodiment according to FIGS. 6 and 7 the clamp cable has two free ends in contrast to the endless clamp cable according to FIG. 4. The free ends of the clamp cable are connected within the casing 5 on a cross stay 33' biased in a forward direction by the spring 18.

In FIGS. 8 to 10 a preferred sole construction for a boot is shown, which is particularly suitable for the above described binding-shoe combination. Accordingly the sole is reinforced in the forward and central area by a foil-like insert 41. In concrete terms this involves a hard elastic plastic insert, which is embedded in an otherwise substantially softer sole material. The sole preferably consists of weather-resistant and resilient elastic rubber. This material is preferably used for soles of touring and telemark boots. By means of the insert, the sole and thus also the boot is given an increased lateral stability and distortion resistance, as indicated by the double arrows 42 in FIG. 10. The flexibility of the sole in the longitudinal direction of the boot or in a vertical plane extending in the longitudinal direction of the boot, is above all not impaired by the insert 41 when it has at least one area of articulation in a direction parallel to the sole and roughly perpendicularly to the longitudinal axis of the boot. In the present case, three areas of articulation 42 are provided, which are located in the ball area of the foot at a predetermined spacing from one another. In concrete terms, the areas of articulation 42 are defined by beads on both sides.

Alternatively, an insert of metal wire according to FIGS. 11 and 12 is possible, and according to FIG. 12 three metal wire rings 43, 44, 45 are provided, which are connected together in the ball area, forming links or areas of articulation 42 extending parallel to the sole and transversely to the longitudinal direction of the boot. The lateral stability of the sole obtained by the inserts described is indicated by the double arrows 46 in FIGS. 9 and 12. The inserts 41 thus in fact particularly influence the lateral stability of the rear half of the boot sole or of the boot.

The sole construction described above consequently has an extremely well-defined flexibility, which is of particular importance especially for telemark boots. In addition this sole construction is also of advantage in combination with the binding described above in view of the fact that the attachment of the boot is effected exclusively in the area of the forward sole 15. At this point, the sole must be particularly stable, without impairing the flexibility of the vertical plane extending parallel to the longitudinal direction of the boot.

Within the scope of the invention described it is also imaginable to connect the free ends of the clamp cable at both outer sides of the forward sole, e.g. in laterally projecting mushroom pins, eyelets or the like. Moreover the clamp cable is passed about a deflector block, which is a part of the binding and is biased by a spring or the like resilient member in such a way that the clamp cable when in use is under traction. The deflector block is connected to a clamp lever, particularly in the way described above.

Instead of a clamp cable, whose free ends may be connected laterally to the forward boot sole, there may also be provided two closure levers articulated to a retainer block which is resiliently biased in a forward direction, said levers being pivotal in a vertical plane extending roughly parallel to the longitudinal direction of the ski and boot. The free ends of the two levers can be hook-shaped, so that for example they may be engaged on pins projecting laterally to the forward boot sole.

FIGS. 13 to 15 show a further embodiment of a combination of ski binding and boot, there being attached to the cover surface of a ski 19 a binding 10, which has a retainer portion 54 for the forward end 47 of a ski boot 11, or the forward end 53 of the associated boot sole 51 on the one hand, and a resilient elastic clamp member 48 on the other hand, which may be coupled with its rear of ski end 50 to the boot sole 51, particularly between the ball area and, as here, the rear end of the same. The clamp member 48 is formed as a spring leaf and consists of mechanically high-loading material stable at low temperatures, such as stainless steel, plastics, particularly plastics composite material. The rear end 50 of the clamp member 48 is bent upwards in a hook shape for purposes of engaging in a recess 55 corresponding to the transverse groove of the prior embodiments on the underside of the sole 51 of the boot 11, as may be seen from FIGS. 14 and 15. The groove or recess 55, as in the prior embodiment, and shown in the drawings of FIGS. 13–15, extends transversely across the sole and forms a transverse wall engaged by the clamp member 48. A strip-like area 69, as shown in FIGS. 13 and 16, is provided at the rear end 50 of the clamp member 48, so that snow can escape between the rear end 50 and the recess 55. In accordance with FIG. 17, the hook shaped end 50 of this clamp member 48 is bent forwards in a sickle shape in plan view, so that the two outer areas 56, 57 have a radius of curvature R1, which is smaller than the radius of curvature R2 of the area 58 lying in between, the last-named radius being almost infinitely large in dimensions. In this way a high lateral stability is achieved of the boot relative to the ski 19. In the connecting area of the clamp member 48, the boot cannot deviate laterally or out of the clamp member 48, and thus cannot slip out of the binding 10. For this purpose, the recess 55, associated with the hook-like end 50 of the clamp member 48 on the underside of the sole 51, is preferably configured to complement this, as shown in FIG. 17. The recess 55 in the boot sole 51 receiving the hook-shaped end 50 of the clamp member 48 can be reinforced, particularly within a hard resilient insert 70 (see FIGS. 16 and 19). The hard resilient insert 70 preferably extends, as FIG. 19 shows, over the entire forward and central area 53, 16, 59 of the boot sole 51 and thus ensures a high degree of power transmission. In this case it is glued over the entire surface between the insole and the tread sole.

The clamp member 48 is mounted to be mobile parallel to the longitudinal direction of the ski. It can be biased by means of a directly or indirectly engaging spring member, here a helical spring 62, in a resilient elastic way, and in a forward direction. A reliable and permanent engagement of the hook-like end 50 of the clamp member 48 in the said recess 55 on the underside of the sole is ensured on the one hand in that the helical spring 62 biased in the forward direction in the closed position of the binding holds the hook-shaped end 50 in the recess 55 with permanent resilient bias. In the embodiment shown, the helical spring 62 is secured with its read end 61 at the front end 49 of the clamp member 48 at one end and with its forward end 63 in the region of the free end of a clamp lever 64 at the other end. The pivot lever 64 is likewise a part of the binding 10 and pivotal inside a binding casing about an axis 65 extending transversely to the longitudinal direction of the ski and roughly parallel to the ski cover surface, out of a closed position (shown in continuous lines in FIG. 14) into an open position (shown in dotted lines in FIG. 14) and vice versa. In the closed position of the clamp lever 64, the spring 62 is located, under bias, in a position past the dead point relative to the connecting line between the pivotal axis 65 and the point of attack of the spring 62 on the forward end of the clamp member 48. As this involves a known construction, more precise illustration and description is unnecessary.

In concrete terms, in the embodiment shown, the forward end 53 of the sole 51 of the ski boot 11 is held by projections 54 formed on the binding casing, and engaging over the front end of the sole 53. On these projections, the forward end of the sole 53 is supported upwardly and to the side and to the front. The support of the boot 11 to the back is effected by the under-engaging engagement of the rear-of-ski end 50 of the resilient elastic clamp member 48 on the underside of the boot sole 51, as FIG. 15 shows.

Associated with the clamp member 48 are also means for altering its effective length, and thus for altering its bending line and elasticity. In concrete terms this involves a web 52 extending transversely over the clamp member 48, and which is displaceable in the longitudinal direction of the clamp member 48 or in the longitudinal direction of the ski relative thereto.

FIG. 18 shows a displacement construction for the web 52, which is omitted from the overall construction for purposes of clarity in FIGS. 13, 14 and 15. A roughly plate-shaped extension 66 extends from the binding casing backwards. This extension is mounted together with the binding 10 directly on the ski cover surface. A screw connection in the assembly bore 69 shown in FIG. 18 ensures a secure connection with the ski 19. However, the extension 66 may also be securely connected to the binding casing, so that only the binding casing together with the extension 66 need be mounted in the previous way on the ski 19. Further manipulations of the ski can thus be avoided. On both sides of the extension 66 there are formed, extending parallel to the longitudinal direction of the ski, guide grooves 67, in which the web 52 engages with its two front ends laterally, in such a way that it is displaceable in the longitudinal direction of the ski and is held in the vertical direction. The relative position of the web 52 is in this case fixable on both sides of the ski 19 by clamp screws 60, which may be screwed into recesses 68 formed laterally on the extension 66. Thus the position of the web 52 may be securely fixed and altered as required.

The displaceable web 52 permits adaptation of the flexibility and bending line of the clamp member 48 and thus of the boot sole 51 to requirements in this area. For example, the flexibility of the clamp member 48 is increased, if the web 52 is displaced forwards.

The web 52 is exposed to considerable loads. Accordingly this component also consists of mechanically high-stress material stable under cold conditions, such as stainless steel, plastics or the like. The spring leaf-like clamp member 48 described can be adjustable in the longitudinal direction of the ski, e.g. for adaptation to different boot sizes. For this purpose it is imaginable to provide at the forward end 49 of the clamp member 48 a plurality of engagement holes, spaced apart from one another in the longitudinal direction of the ski, for the rear end 61 of the helical screw 62. In this way the relative position of the clamp member 48 to the binding casing is adjustable.

By means of the resilient elastic clamp member 48 in the form described, exact lateral guidance of the boot 11 is ensured. Moreover, by means of the clamp member 48 the bending line of the boot sole 51 in the ball area 59 is defined, and can be altered by the said web 52. The bending line predetermined by the clamp member 48 is also extensively independent of the elasticity of the boot sole 51 or of the alteration in the same during skiing. The recess 55 associated with the rear end 50 of the resilient elastic clamp member 48 on the underside of the boot sole, is simple to manufacture. The effect on the boot sole 51 of manufacturing procedures is minimal in view of the fact that between the forward sole and the boot heel 13 in accordance with the curvature of the foot, a sole curvature 16 is provided, on the forward boundary of which the recess 55 can be produced extremely simply and easily accessibly. Instead of the leaf-spring-like design of the clamp member 48 it is also possible to use a relatively narrow spring steel strip as a clamp member.

All the features named in the application documents are claimed as essential to the invention, insofar as they are not known either individually or in combination.

What is claimed is:

1. In combination, a ski binding particularly adapted for cross-country, touring or telemark skiing, said ski binding having a toe member (54) constructed and configured for attachment to a ski, a boot (11) adapted for said skiing, said boot having a sole with a forward sole (15) terminating in the front portion of the boot and the front of the sole configured and constructed to engage said toe member and hold the front of the sole abutting the ski binding, said sole including a central area (16) connected to the forward sole by a transitional area and extended rearwardly to a heel (13), and said sole being constructed and configured to permit substantial bending of the sole relative to said engagement of the front portion to said binding and thereby substantially raising of the heel relative to the ski and said ski binding including a resilient elastic biased clamp cable (62) having an end member fixed to the toe member and having outer end members and having a connection of said outer end members to the forward sole and forward of the heel, the improvement in said connection of said cable 62 to said ski boot wherein said sole includes a groove (55) formed directly within the sole and said groove having a transverse vertical wall within and extended across said sole, said groove in said sole being spaced and located within said forward sole and forwardly of said heel, a substantially flat spring band elastic member (48) having a hook portion releasably directly engaging said groove in said sole and engaging said transverse vertical wall and having a flat portion extending therefrom beneath and in engagement with the sole from said groove to the front end of the sole, said outer end members of said clamp cable (62) being attached to said spring band elastic member (48) adjacent the front end of said forward sole and thereby said clamp cable (62) is operatively connected by said spring band elastic member to the sole and secures the hook portion in said groove with a permanent resilient bias and with said sole held within said toe member and further provides for substantial raising of the boot heel with substantial bending of the engaged elastic member (48) and the abutting sole of the boot during the cross country tourism and telemarking skiing.

2. The combination of claim 1 including a bending control member (52) secured to said spring band elastic member for displacement in rearwardly spaced location to the front end of the sole, and wherein said outer end members of said clamp cable (62) are secured to said bending control member and thereby to said band elastic member (48), the location of said control member (52) varying the displacement along the length of said spring band elastic member determining the flexibility and the bending line of the spring band elastic member and the interconnected boot sole.

3. The combination of claim 2 wherein said bending control member (52) is a web member (52) coupled to said spring band plastic member.

4. The combination of claim 3 wherein said web member is formed of a high stress material having high stability in cold conditions as encountered in cross country skiing.

5. The combination of claim 4 wherein said web member is adjustably mounted to the spring band elastic member.

6. The combination of claim 4 wherein said spring band elastic member has side walls, said web member has a generally U-shaped configuration extended over the spring band elastic member and having depending side walls engaging said side wall of said spring band elastic member, and having an element releasably interconnected to the side walls of the web member for selective engagement with said side walls of said spring band elastic member for locating and adjusting the relative position of said web member.

7. The combination of claim 4 including a rigid plate member secured beneath said spring band elastic member, said web member having side walls extending over said spring band elastic member and said rigid plate member and a releasable member in said side wall of said spring band elastic member engaging said rigid plate member to secure said web member in place.

8. The combination of claim 1 wherein said spring band elastic member is a spring leaf.

9. The combination of claim 8 wherein said spring leaf is formed of a high loading material stable at low temperatures.

10. The combination of claim 9 wherein said material is selected from the group consisting of stainless metal, plastic and plastic composites.

11. The combination of claim 6 wherein said hook portion is formed with a sickle shape in a plan view and includes two outer areas (56,57) with a radius of curvature (R1) which is smaller than the radius of curvature (R2) within the area therebetween, said curvature (R2) having a radius very substantially larger than that of said outer areas (56,57).

12. The combination of claim 3 wherein said web member is a solid web plate member (62) extending transversely across the sole.

13. The combination of claim 12 wherein said web member (52) includes a fixing device (60) for securing the web member in place and thereby setting the bending line and elasticity.

14. The combination of claim 1 wherein said hook portion of said spring band elastic member (48) has an opening (69) mating with said groove wall (50) in said sole.

15. The combination of claim 1 wherein said groove is located at the rearward end of said forward sole (15).

16. The combination of claim 1 wherein said groove is located between the ball area and the rear end of said forward sole.

17. The combination of claim 1 wherein said groove is located within the transitional area between the forward sole (15) and the central area (16).

* * * * *